US006113004A

United States Patent [19]

Steingass et al.

[11] Patent Number: 6,113,004

[45] Date of Patent: Sep. 5, 2000

[54] PORTABLE KIT FOR FIREFIGHTERS

[75] Inventors: Robert W. Steingass; Ross J. Mack, both of Valparaiso, Ind.

[73] Assignee: Task Force Tips, Inc., Valparaiso, Ind.

[21] Appl. No.: 08/634,808

[22] Filed: Apr. 19, 1996

[51] Int. Cl.[7] ..... A62C 15/00

[52] U.S. Cl. ..... 239/152; 239/343; 239/375; 239/390; 239/525; 169/30

[58] Field of Search ..... 239/399, 405, 239/406, 416.5, 343, 432, 152–4, 390, 302, 525, 375; 169/15, 30, 52, 70

[56] References Cited

U.S. PATENT DOCUMENTS

| | | | |
|---|---|---|---|
| 811,749 | 2/1906 | Somers | 239/525 |
| 1,224,192 | 5/1917 | Mikorey | 239/375 |
| 1,912,759 | 6/1933 | Clark | 239/375 |
| 1,913,006 | 6/1933 | Smith | 239/153 |
| 3,092,330 | 6/1963 | Ridenour et al. | 239/375 |
| 3,802,511 | 4/1974 | Good, Jr. | 169/30 |
| 3,846,515 | 11/1974 | Williamson | 169/15 |
| 3,964,689 | 6/1976 | Horvath, Jr. | 239/375 |
| 4,805,700 | 2/1989 | Hoover | 169/15 |
| 4,810,169 | 3/1989 | Kranzle | 239/152 |
| 5,009,244 | 4/1991 | Grindley et al. | 137/101.11 |
| 5,018,584 | 5/1991 | Tomlinson | 169/30 |
| 5,054,688 | 10/1991 | Grindley | 239/407 |
| 5,137,094 | 8/1992 | Broussard | 169/15 |
| 5,160,071 | 11/1992 | Wright | 239/375 |
| 5,165,442 | 11/1992 | Fiala | 137/118 |
| 5,228,624 | 7/1993 | Mansink | 239/406 |

OTHER PUBLICATIONS

Bulletin of Angus Fire Armour: Angus AF 120 Mobile Foam Unit (date unknown).

Bulletin of Accu–Foam Div. of Custom AG Products, Inc.: Series 19–2 Accu–Foam Controller, injection systems, and powerpack; (dates unknown).

Bulletin of Magnum Fire & Safety Systems: Firecat Foam Monitor Cart (date unknown).

Bulletin of Scott Plastics Ltd.: Scotty Backpack, Inductor and Nozzle; Scotty Firefighter Back–pack with Fire Pump; Scotty Firefighter Back–pack and Firepump #4000; Scotty Firefighter Hip–pack 4001 and Back–pack 4002; Scotty Firefighter Garden Hose Foam Kit 4070–3 and Foam Kit f#4075–50; Scotty Foam Mixer 4070 (dates unknown).

Bulletin No. 82003 of Dema Engineering Co.: Portable Foamer Model 297 (date unknown).

Bulletin No. 81007 of Dema Engineering Co.: Handi–Spray Model 282 (date unknown).

Bulletin Y–FASAFFF of 3M on Light Water Solid AFFF Fire Extinguisher (date unknown).

Bulletin of Groupe Leader SA on Alphamousse Mobile Unit (date unknown).

Bulletin PAM 4/84–5M of Angus Fire Armour Corp. on Foam Fire Fighting Equipment, including AF 100 Mobile Foam Unit (date unknown).

Bulletin of Flameco Div. of Robwen, Inc. on Flameco Foam Guard (date unknown).

(List continued on next page.)

*Primary Examiner*—Andres Kashnikow
*Assistant Examiner*—Lisa Ann Douglas
*Attorney, Agent, or Firm*—Marshall, O'Toole, Gerstein, Murray & Borun

[57] ABSTRACT

This disclosure relates to a portable kit for use in fighting fires, and includes a portable tank forming a reservoir for a liquid additive. A handle extends adjacent an upper side of the tank and is fastened to the tank, the tank and the reservoir being sized to be carried by a person holding said handle. At least one accessory is provided and the tank has at least one storage recess formed in its outer surface, the recess being shaped to receive and store the accessory. A liquid flow passage having an inlet end coupling and an outlet end coupling is also fastened to the tank, and the flow path may be formed through the handle. The inlet end coupling is connectable to a supply of liquid under pressure, and the outlet end coupling and the accessory are shaped to be coupled together.

6 Claims, 10 Drawing Sheets

OTHER PUBLICATIONS

Bulletin of Robwen, Inc. on Flow Mix Model 500 Foam Proportioner (date unknown).

Bulletin of Firecraft Division of Western Fire Equipment Co. on Rover Foam Cart (date unknown).

Brochure of Scott Plastics Ltd. showing Hip–pack #4001; Back–pack #4002; Foam Fire Pump Model #4000F with Back Pack; Foam Kits #4075–50, #4073 and #4070 H/AT (date unknown).

Bulletin of Hypro Corporation—Form 852—on Foam Pro Model 1600—dated Feb. 1996.

Brochure of Delta Fire Ltd. showing Prima Foam Units LX–Prima and MX–Prima; DF 130 Mobile Foam Unit (date unknown).

1
2
3
4
6A
6B
8
10A
71
72
73
74
76
77
78
81
82
83
84
85
91
92
93
94
96
99

PORTABLE KIT FOR FIREFIGHTERS

FIELD AND BACKGROUND OF THE INVENTION

This disclosure generally relates to improvements in portable apparatus for use primarily by firefighters.

Chemical agents are frequently added to water by firefighters to enhance the firefighting properties of plain water. These additives include but are not limited to compounds for better extinguishment and wetting ability, and for increasing the volume of the water which is useful in blanketing areas with foam. In recent years many types of additives have been found useful for fire departments.

Some agents or additives when proportioned into water can be made to form foam when aspirated with air. These additives when in their liquid state are referred to as foam concentrates. The foam that is formed is sometimes designed to form a blanket that covers burning hydrocarbon fires, whereby the blanket floats, and spreads out to seal off the formation of flammable vapors. Liquid fuels are referred to as CLASS B. Other foams are intended to form a thick blanket over hydrocarbons or chemicals in order to inhibit the formation of vapors that could ignite, or are harmful. Vapor mitigation of hazardous materials is referred to as HAZMAT.

Recent advances have been made in new types of water additives that are intended to be applied to solid organic fuels such as wood, brush, pine needles, grass, grain and the like. These solid carbon based fuels are referred to as CLASS A. The water additives for CLASS A fuels greatly enhances the penetrating and wetting ability of the water. When wetting ability or reach is the dominant factor, the solution (water plus additive) is usually applied in a straight jet. Other water additives not only act as wetting agents, but are designed to be mixed with water, and are aspirated with air to form foam. Sometimes it is desirable to apply the solution in a wet sloppy foam for soaking down into a deep fuel load, such as several inches (or 200 mm) of pine tree needles. Other times the foam is applied in thick blankets for its insulating ability in protecting against the advancement of fire.

It is apparent that the methods and tactics for applying these different types of chemicals are quite varied; however the usefulness and effectiveness of adding chemical concentrates to plain water is well known to the modern firefighting services.

The addition of chemical foam concentrates to water by fire department personnel has been done in a variety of ways, but can be generally classified into two methods. One method is to add the concentrate to the water at or near the fire truck. The second method is to add the concentrate approximately at the point of usage, that being the discharge end of the fire hose.

While portable foam reservoirs containing water and foam concentrate in either liquid of pellet form have been used for several years, such as the "Light Water" brand solid AFFF sold by 3M, and the type sold by Scott Plastics LTD company of Victoria BC Canada, the reservoirs have substantially limited usefulness as a portable unit because the majority of their weight is in water. Consequently, their extinguishing ability is severely limited, and they will not achieve the effectiveness as a portable system as the present invention if constructed of an equal weight.

The present invention relates to point of usage type of proportioning systems connected to a pressurized source of water by a hose. Point of usage proportioning systems can be further divided into those systems that have the concentrate pumped through a separate hose to the point of usage, and those systems generally referred to as portable. The present invention is classified as portable.

Portable proportioning systems are intended to be stored in a ready to use condition so that they can be quickly deployed by a single person. Adding concentrate at the point of usage with portable systems has in the past been generally limited to smaller applications of foam because of the logistical limitations of having to carry the concentrate to and around with the end of the hose. This method however can be advantageous over truck dispensed concentrate systems because the person applying the foam can control the dispensing of the foam concentrate. In truck mounted systems, this control is given to the pump operator who cannot see nor respond to the changing fire area situation as quickly as the person at the end of the hose. This method is advantageous over point of usage methods with pumped concentrate supply for the same reason, and in addition portable systems have increased mobility.

The benefit of releasing a chemical into the environment must be weighed against the potential for damage on the environment. It is becoming increasingly evident that spillage and wastage should be kept to a minimum. Small portable systems can quickly and easily be brought to the scene and used with high accuracy so that environmental impact is minimized.

Portable point of usage systems including flexible foam storage bags designed to be worn by the firefighter have been used, such as a system depicted in U.S. Pat. No. 5,137,094, and those appearing in a catalog of Scott Plastics Limited, Victoria BC Canada. While they may be comfortable to wear for extended periods of time, they must be strapped on, thereby decreasing their speed of deployment. Only one type of discharge device is connectable to the discharge end of the hose at a time, and there is no provision for self contained storage of a variety of discharge devices. Thus these systems have a limitation in that, when a different discharge device is needed, it will probably not be immediately available.

In Europe, a portable point of usage proportioning system has been manufactured by the Delta Fire company in the UK. This system is usually stored connected to a fire hose, and can be instantly picked up and carried to the scene. It is equipped with rapid connectors so that either low expansion or medium expansion foam aspirating nozzles can be connected to a discharge hose. However, this system has no provision for storage of these multiple attachments or discharge devices in a unitized package. The attachments are therefore likely to be misplaced or lost, or become unavailable to the operator at the time when they are needed when the system is in use at the end of the hose.

Wheeled carts containing foam reservoirs, a discharge device, and an eductor are not truly portable because they are too heavy to be carried. For example a cart of typical size sold by Angus Fire Armour weighs over 400 lbs (183 KG) when filled with foam additive. A cart lacks speed of deployment and mobility at an emergency scene such as a vehicle crash, moving in rough terrain, or in structures where stairs are present. The hose into the reservoir is of a considerable length, making detection of the remaining foam supply by the nozzle operator difficult or impossible. These systems are intended to be operated by one person at the foam tank, and one person at the nozzle. Further, these systems are equipped with only one type of nozzle, and thus are limited in the style of discharge they can produce.

It is a general object of this invention to provide an improved portable system which avoids the foregoing disadvantages of the prior art.

SUMMARY OF THE INVENTION

Apparatus in accordance with the present invention comprises a portable point of usage kit including an additive storage tank and proportioning system that is connectable to a fire hose, and further includes a variety of accessories including a number of discharge devices. The proportioning system includes an inlet adapted for connection to a pressurized water source such as a fire hose, and a valve communicating and selectively controlling the passage of water to an eductor. Flow of pressurized water through the eductor causes a partial vacuum to be created in the throat of a constricted section whereby a water additive such as but not limited to foam concentrate can be drawn into the throat by means of a flow passage established between the throat and a liquid additive reservoir in the storage tank. The flow of liquid additive is restricted by a variable orifice to control the proportion of the additive into the flow of water. The liquid additive and water are combined at the throat of the eductor, and are discharged through a flow path that is connectable to accessories such as various types of discharge devices, or to a discharge hose, by means of quick-connect couplings. The discharge devices include, for example, a straight jet nozzle, a low expansion foam aspirator, and a medium expansion foam aspirator. The discharge hose may be connected between the discharge of the eductor and a selected discharge device, thereby extending their reach and maneuverability. The foam storage tank is shaped in such a way that it forms a unique storage area for the accessories. There is thus formed a self-contained kit including a tank and accessories or attachments, and the accessories are protected from abuse because of a partial envelopment by the tank about the accessories.

BRIEF DESCRIPTION OF THE DRAWINGS

The foregoing and other objects and advantages of the present invention will become more apparent from the following detailed description taken in conjunction with the accompanying figures of the drawings, wherein.

DETAILED DESCRIPTION OF THE DRAWINGS

Figure 1:
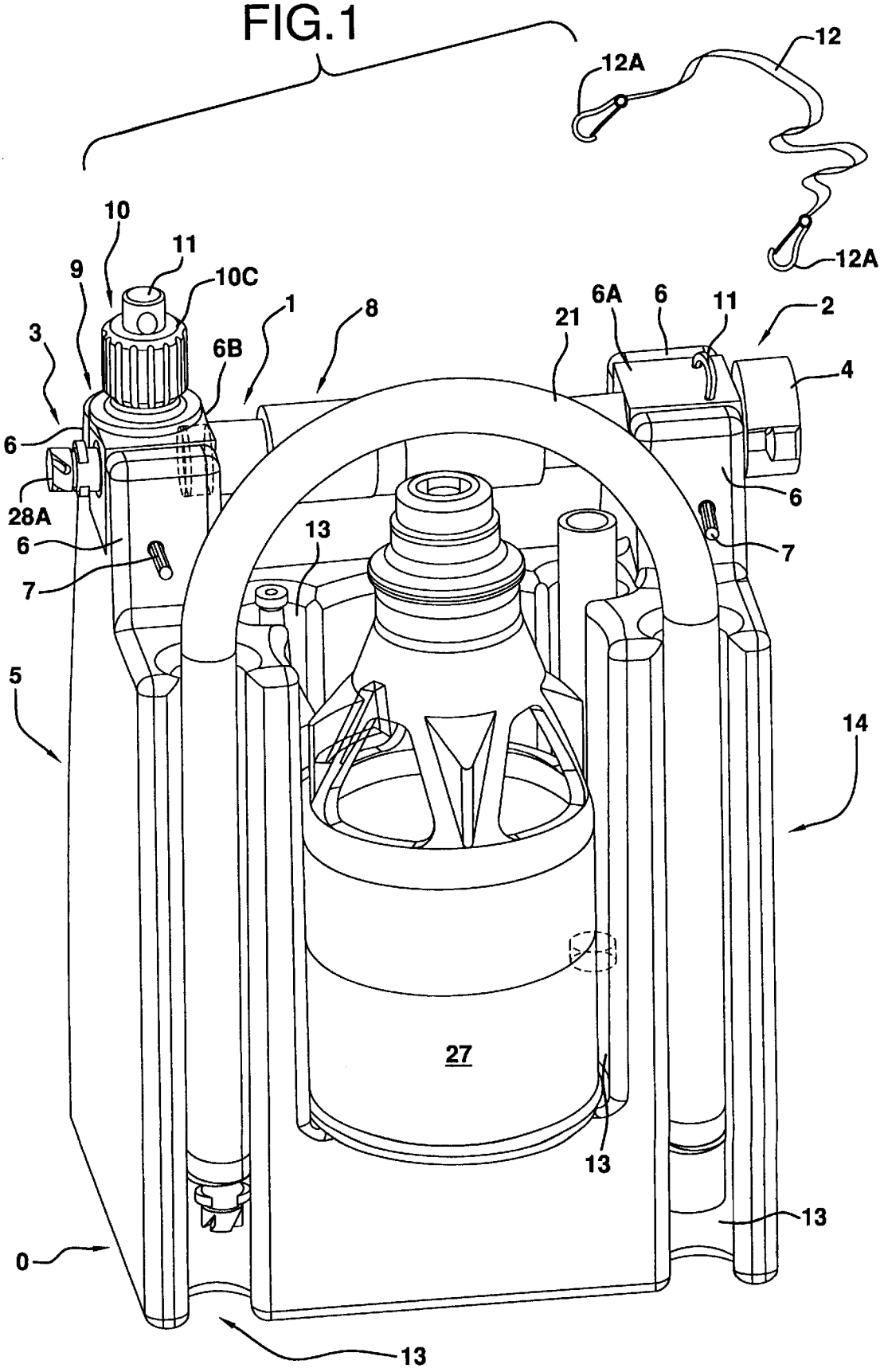
FIG. 1 is a perspective view of a kit showing the accessories in their stored positions.

With reference first to FIG. 1, there is illustrated a portable fire fighting kit 0 including a tubular flow path 1 having a supply or liquid inlet end 2 and a liquid discharge end 3. At the supply end 2 there is provided a coupling 4 for securing the path 1 to the discharge end of a supply hose (see the hose 17 in FIG. 2) in a conventional manner. A liquid additive concentrate tank 5 forming an additive reservoir is secured to the underside of the tubular flow path 1. The tank 5 is preferably formed of a strong molded plastic, and two pairs of projections 6 are formed on the upper end of the tank 5. The projections 6 of each pair are spaced apart and the flow path 1 extends between them. Cubes or blocks 6A and 6B (which may be made of plastic or metal) are positioned between the two pairs of projections, and the flow path 1 extends through holes formed in the two blocks. Extending perpendicularly to the holes for the flow path 1 are retainer or cross pins 7 which extend through the projections 6 and the blocks 6A and 6B and retain the blocks on the tank 5. The pins 7 are preferably removable so that the blocks and the flow path may be removed from the tank.

Figure 3:
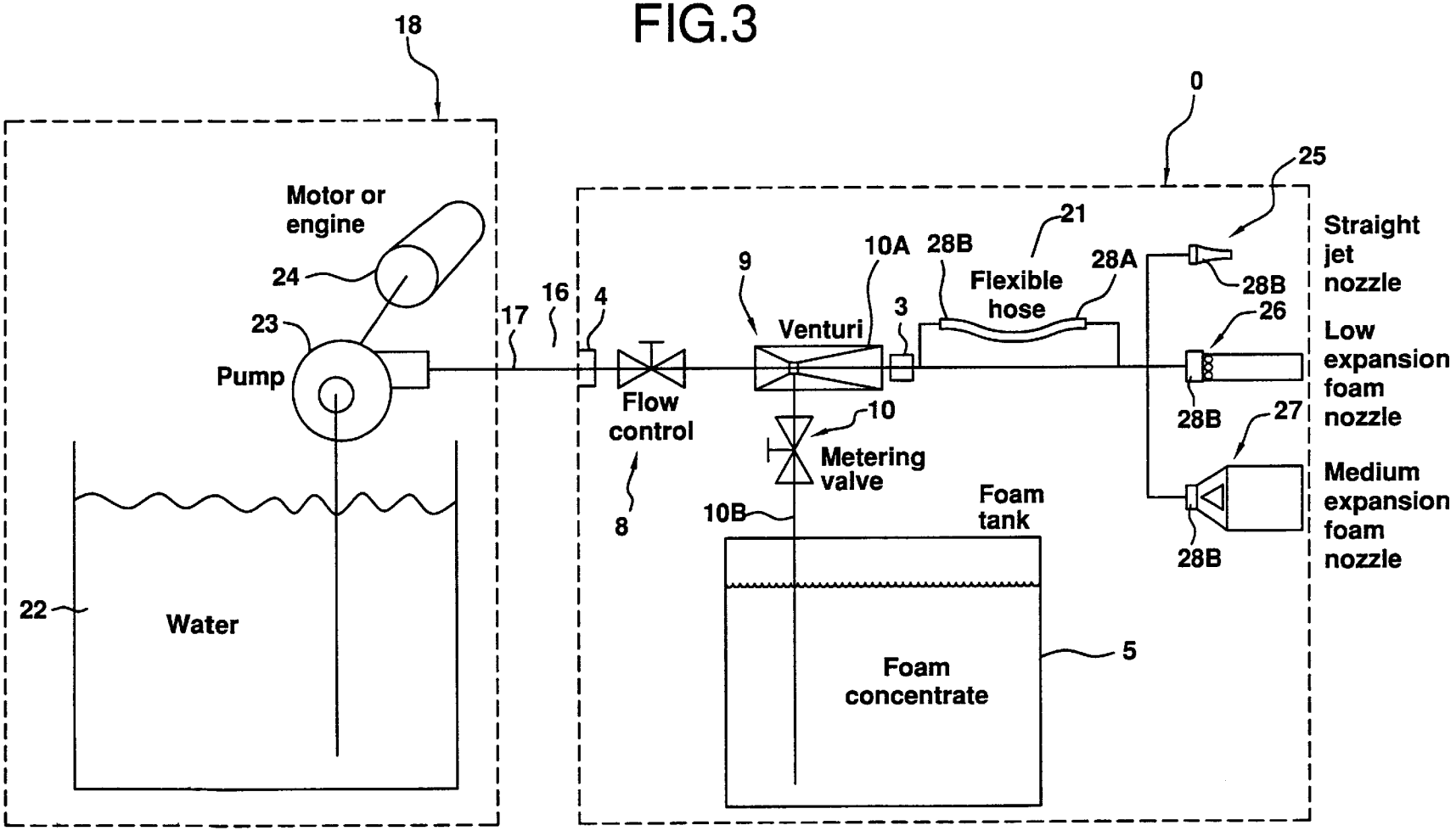
FIG. 3 is a schematic diagram showing the elements of the system of FIG. 2.

The blocks 6A and 6B also include eyelet projections 11 that may be connected to clips 12A of a carrying strap 12. Tubular flow path 1 also has built into it a flow control valve 8 that controls the amount of water that is allowed to pass through an eductor 9 (see also FIG. 3). Eductor 9 includes a venturi 10A and a liquid additive metering valve 10 (FIG. 3) for controlling the proportion or percentage of additive sucked out of tank 5. Within the block 6B at the discharge end of the flow path 1, the flow path 1 includes the venturi 10A; as shown in FIG. 3, a tube 10B extends from the venturi 10A, through the flow control or metering valve 10, to near the bottom of the reservoir in the tank 5. An adjustable control knob 10C on top of the block 6B controls the metering valve 10. Tank 5 is equipped with a fill port 31 (FIG. 5A) for filling with any desired liquid chemical additive concentrate. As will be described later, the tank 5 is shaped with one or more storage recesses 13 (see FIGS. 1 and 4) forming storage areas into which are fitted one or more accessories 14 such as supply end discharge devices and hose.

Figure 2:
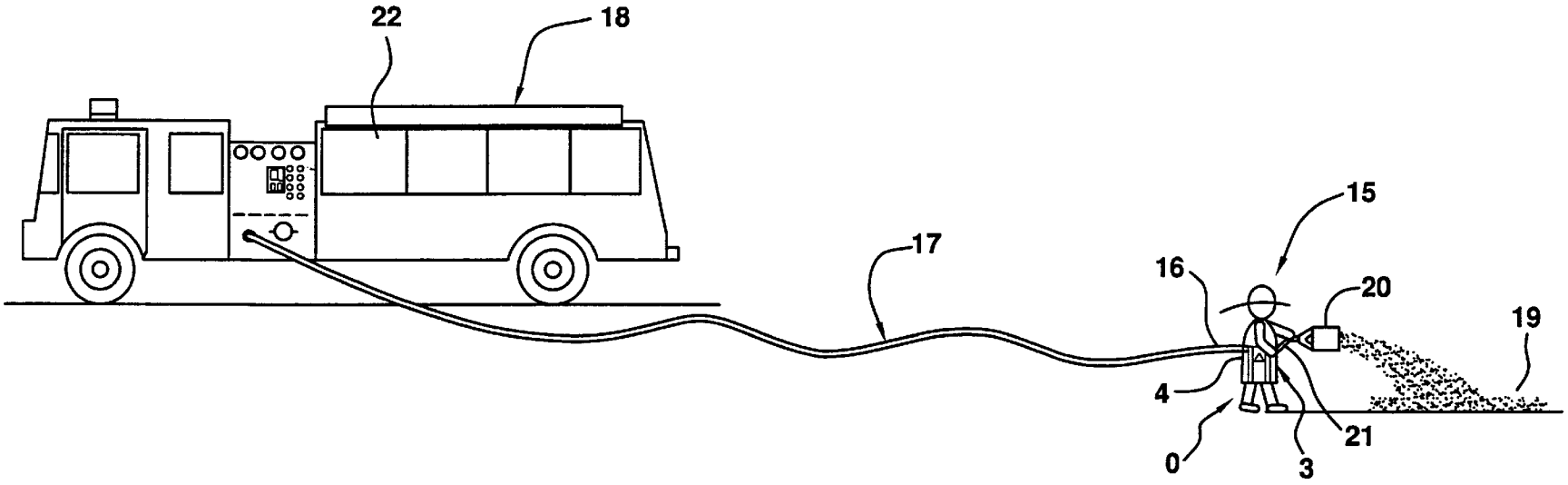
FIG. 2 is a view illustrating a fire scene including the kit in use on a fire.

With reference to FIG. 2, the kit 0 is shown being carried and operated by person 15, normally a firefighter. Coupling 4 is secured to the exit end 16 of a fire hose 17 which receives water from a pressurized source 18 such as fire truck 22. The pressurized source could instead be a city water supply, or a hydrant system in a factory or store or the like. The person 15 is shown discharging foam 19 with an aspirating nozzle 20 that receives fluid from the discharge end 3 of the flow path 1, through a hose section 21. This configuration is but one example of the several useful combinations possible, as will be described.

The components depicted in FIG. 2 are shown in schematic format in FIG. 3. The pressurized source 18 generally includes a water supply in the truck 22, and a pump 23 driven by a motor or engine 24. The kit 0 includes a plurality of accessories 14 (FIG. 4) such as a hose section 21, a straight jet nozzle 25, a low expansion nozzle 26, and a medium expansion nozzle 27, each of which is adapted for connection to the liquid discharge end 3 of the flow path. The end 3 includes a coupling half 28A such as a threaded coupling, a snap fitting connector, or a quick connect coupling. A coupling half 28A is also provided on the outlet end of the hose 21. Identical connectors 28B, each of which mates with the halves 28A, are provided on the intake end of each of the accessories, so that a selected one of the accessories may be coupled to the end 3, as will be described in connection with FIGS. 5A to 5F.

Figure 4:
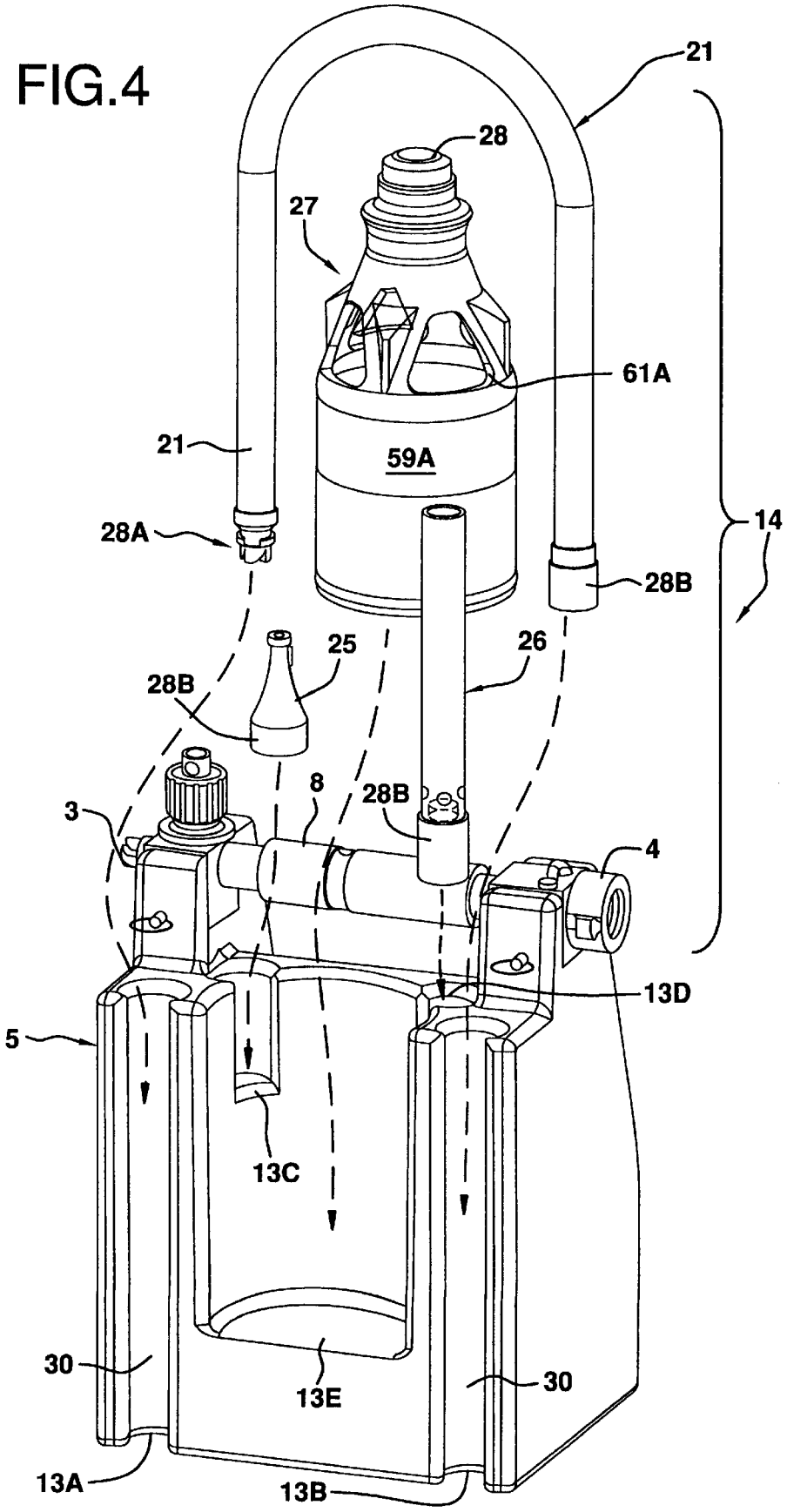
FIG. 4 is an exploded perspective view of the kit.

FIG. 4 is an exploded perspective view of the kit 0 with all of the accessories 14 removed from their stored positions. The molded tank 5 is configured or shaped to form a plurality of storage recesses 13A to 13E, each of which is shaped to accept an accessory 14. Each storage recess partially wraps around or encloses a substantial portion of its associated discharge device 14 thereby protecting it from external abuse and preventing it from falling out, and presenting an appearance of a well thought out kit of tools. The two elongated recesses 13A and 13B receive the end portions of the hose 21, the two shorter recesses 13C and 13D receive the two nozzles 25 and 26, and the large center recess 13E receives the largest nozzle 27. Each storage recess 13 is preferably shaped so as to retain the accessory by sliding it in a downward direction as indicated by the dashed arrows in FIG. 4, whereby retention is primarily by gravity. If the tank 5 were to fall over, then the discharge devices could fall out and become lost, and therefore a secondary method of retention is preferred. As for the discharge hose 21, this hose is preferably constructed of a flexible material that resists kinking or flattening. Flexure of the hose from it's normally somewhat straight condition into the U shaped storage condition (shown in FIG. 4) will forcibly retain the hose in it's storage recesses due to its tendency to straighten out. The storage recess 13C for the straight jet nozzle 25 may be made with a slight taper, or draft, providing a slight interference fit as the nozzle is pushed to it's lower stored position. The other nozzles 27 and 28 may be similarly attached by a tight fit. Secondary retention may also be effected, or augmented, by an elastic strap, a catch or latch, or a Velcro® strap (not illustrated). When the kit is picked up and carried, the accessories are securely held in position and will not fall out or become dislodged through rough handling.

As mentioned above, each storage recess 13A to 13E in the preferred embodiment only partially envelopes its accessory and has an open side 30. Open sides 30 provide good visibility and improved access for removal of the accessories. The tank 5 may be easily cleaned of any chemical residues and dirt by spraying it with water, because the open sides 30 avoid a pocket at the bottom of the recess that would otherwise tend to capture these elements.

FIGS. 5A to 5F are perspective views showing several possible combinations of the parts of the kit. In this view, fill port 31 is shown with lid 32 closed which substantially seals the additive into the reservoir of the tank 5. The movement of the lid 32 is effected by finger grip indentations 33. The reservoir 5 is fitted with two elastomeric umbrella valves 34 that are installed in opposite directions to equalize the pressure in the tank to that of ambient conditions.

Figure 5D:
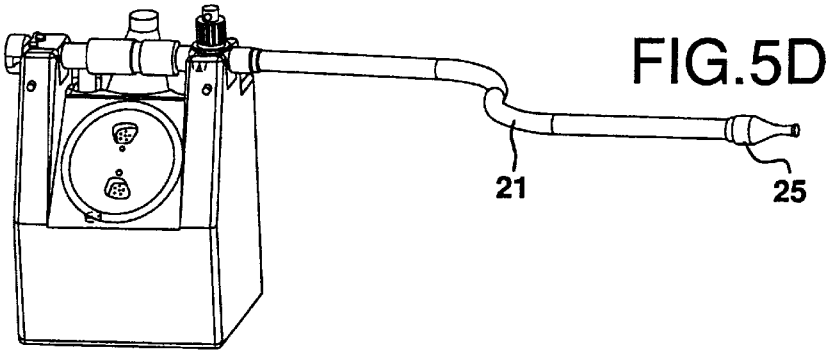
FIGS. 5A to 5F are perspective views illustrating several possible combinations of the accessories of the kit.
Figure 5E:
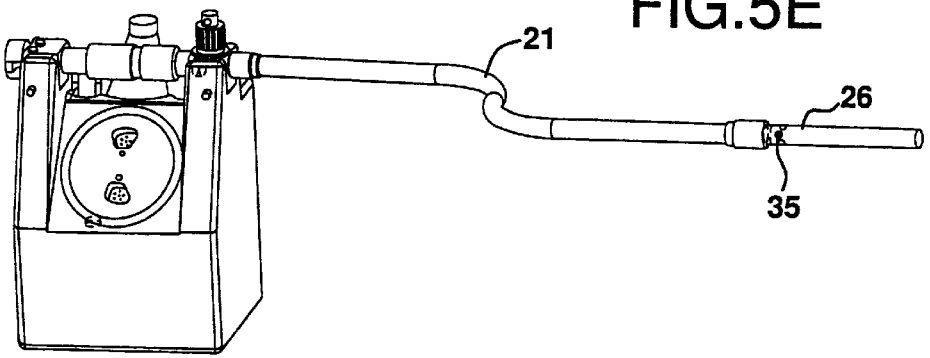
Figure 5F:
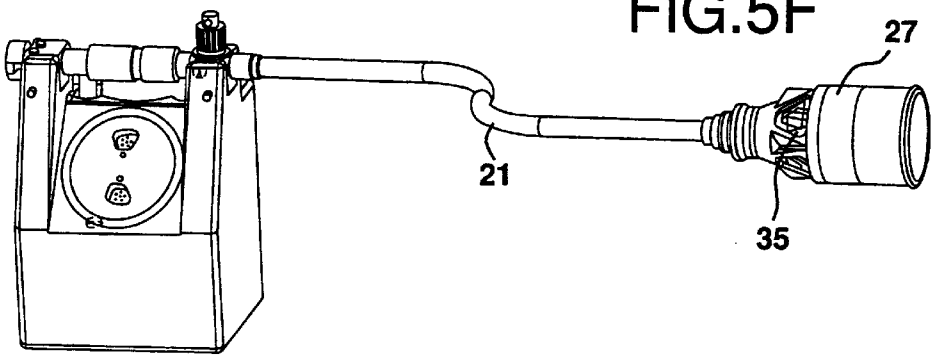
Figure 5A:
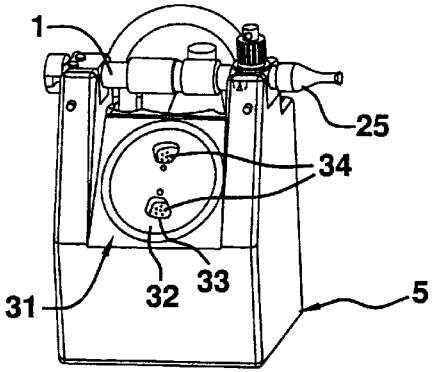

In FIG. 5A, the straight jet nozzle 25 is connected to the end 3 of the tubular flow path 1. This arrangement is useful for application of plain water or water plus a wetting agent additive. The apparatus 0 may be operated with one hand by gripping the portion of the flow path 1 between the projections 6, which also forms a handle. The strap 12 may also be used, of course. The firefighter's other hand is free to carry another device such as a tool or radio.

Figure 5B:
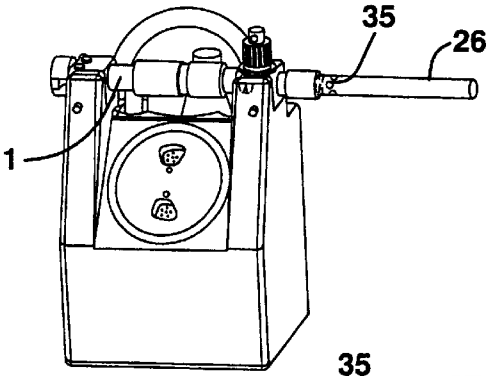

FIG. 5B shows a low expansion foam nozzle 26 connected to the end 3 of the tubular flow path 1 for, for example, the application of wet sloppy foam. When fluid is discharged through a low expansion nozzle 26, a spray is formed which entrains and aspirates air into the spray pattern through aspiration openings 35 of the nozzle. The kit 1 may again be operated with one hand.

Figure 5C:
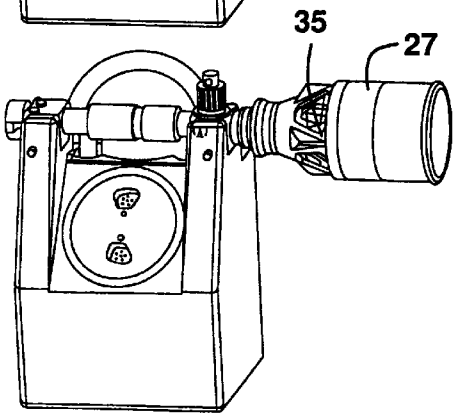

FIG. 5C shows a medium expansion nozzle 27 connected to the end 3 of the tubular flow path 1 for the creation of medium expansion type foams. The spray pattern discharge within medium expansion nozzle 27 and the size of aspiration openings 35 are of larger proportions so that greater amounts of air are incorporated into the spray, thereby forming a greater amount of foam. This is a useful combination for making fire breaks in grass or cropland. In this case the kit may be carried with one hand, or it can be placed on the front bumper of a slowly moving fire truck to discharge foam without an attendant. A line of thick foam is dispensed and driven over thereby trampling and wetting a line of grass fuel. The grass fuel standing between the fire break and the fire can then be ignited to burn back towards the fire, thereby stopping the fire.

FIG. 5D shows the straight jet nozzle 25 connected to the hose 21 which, in turn, is connected to the end 3 of the tubular flow path. This combination gives maximum reach of the jet which may more easily be directed in upwards trajectories. In this example, the nozzle 25 would be held in one hand and typically the tank 5 would be carried in the other hand, or on the shoulder using the shoulder strap 12.

In FIG. 5E, the low expansion nozzle 26 and the hose 21 are connected to the end 3 of the tubular flow path 1. This combination is useful for maximum extinguishing ability on fires of CLASS B fuels, or wet sloppy foam for penetration in CLASS A fuels.

FIG. 5F shows a medium expansion nozzle 27 and hose 21 connected to the end 3 of the tubular flow path. This combination gives maximum flexibility when covering large areas with thick foam blankets.

It is also possible for two or more hoses 21 to be coupled together between the end 3 and a nozzle. This would enable an operator to set the tank 5 on the ground and move about in a limited area with the nozzle.

Figure 8:
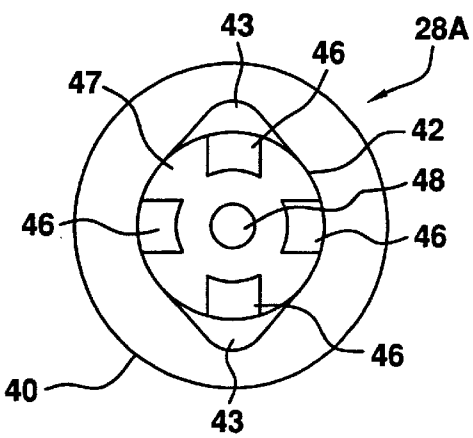
FIG. 8 is an end view of a coupling half.
Figure 6:
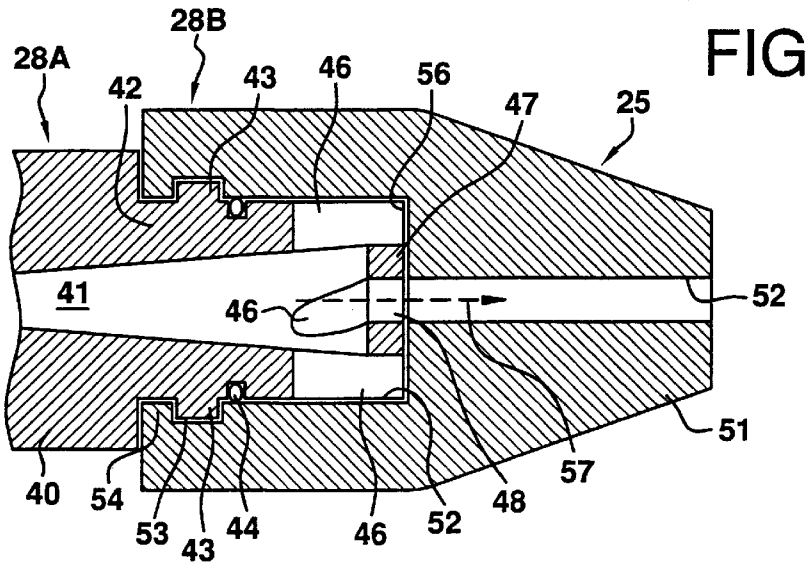
FIG. 6 is a sectional view showing one type of accessory coupled to a flow discharge.
Figure 7:
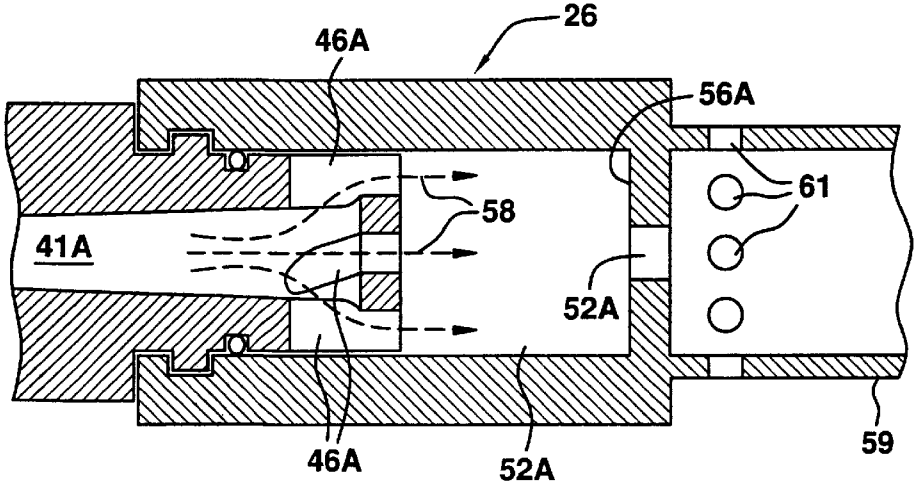
FIG. 7 is a view similar to FIG. 6 but showing a different type of accessory.

FIGS. 6, 7 and 8 illustrate the coupling halves 28A and 28B, the nozzle 25, and part of the nozzle 26. The coupling half 28A comprises a tubular body 40 having a central flow passage 41. In the half 28A formed on the end 3, the passage 41 tapers outwardly as shown from the venturi 9 throat, in the half 28A of the hose 21, the passage 41 may be straight (have a constant flow area). Near its outer end, the body 40 has a reduced diameter circular portion 42, and two radially extending ears 43 (see FIG. 8). An annular groove outwardly of the ears 43 receives an O-ring 44. A plurality (in this instance 4) slots 46 extend through the wall of the body 40 and connect the passage 41 with the outer periphery of the body 40. The slots 46 extend from the outer end of the body 40 up to near the O-ring 44 and they are open to the flow passage 41. Further, and as illustrated in FIGS. 1, 4, 6 and 7, the slots 46 have a circumference curve in addition to extending axially. At the outer end of the body, an end part 47 extends across the flow passage 41, and the part 47 has a centrally located flow hole 48 formed axially through it.

The nozzle 25 (FIG. 6) comprises a nozzle-shaped body 51 having a flow passage 52 formed axially through it, the passage 52 being aligned with the hole 48 when the nozzle 25 is attached to the coupling half 28A. The coupling half 28B is in this example an integral part of the nozzle body 51, and it includes a cavity 52 which is sized to receive the reduced diameter circular portion 42 of the body 40. The rearward (left end as seen in FIG. 6) end of the half 28B has an annular recess 53 that receives the ears 43, and inward flanges 54 that extend behind the ears 43 in order to secure the two halves 28A and 28B together. The flanges 54 are circumferentially spaced to provide clearance therebetween to enable the flanges 54 to be moved toward the left past the ears 43. Thereafter the nozzle body is rotated slightly to move the flanges 54 behind the ears 43.

The outer sides of the slots 46 are closed by a close fit between the inner peripheral surface of the cavity 52 and the radially outer surface of the part 42. In the case of the nozzle 25, the axially forward ends of the slots 46 are also closed by adjoining bottom surface 56 of the cavity 52. Consequently, all of the water flowing into the flow passage 41 flows through the hole 48 and the passage 52 of the nozzle, thereby forming an essentially straight stream flow as indicated by the arrow 57. When using the nozzle 25, either plain water is sprayed or a mixture of water plus an additive from the tank 5 such as a wetting agent.

With reference to FIG. 7 which shows the nozzle 26, only the difference in structure and operation will be described. The bottom surface 56A of the cavity 52A is spaced from the forward (the righthand) end of the slots 46A. Consequently, as indicated by the arrows 58, the liquid under pressure flows from the passage 41A, through the center hole 48A and through the forward ends of the slots 46A. As previously mentioned, the slots 46A are preferably angled, with the result that the liquid leaving the slots is swirled in the cavity 52A between the bottom surface 56A and the coupling half 28A. The liquid then flows through a hole 52A in the bottom surface 56A and through an enlarged and elongated flow tube 59 of the nozzles. A plurality of holes 61 are formed through the wall of the tube 59, and air is drawn into the tube 59 and mixed with the liquid. In this instance, a foam concentrate is in the tank 5 and it is sucked into the venturi 9 and mixed with the water. The liquid mixture is further mixed with air from the holes 61 to form foam as previously mentioned.

FIGS. 9 to 15 show an alternative and preferred construction of the handle and the couplings between the handle and the accessories. This embodiment also includes a tube forming a flow path 1, and a flow control valve 8 is mounted in the path 1. Support blocks 6A and 6B are attached to the ends of the flow tube, and a coupling 4 is provided at the intake end 2.

At the outlet end 3, a coupling half 71 is fastened in the block 6B and, similar to the part 28A in FIG. 6, forms a portion of the venturi 10A. The coupling half 71 is similar to the coupling half 28A in that it includes spaced ears 72 and a seal 73. However, the half 71 does not include slots similar to the slots 46 of FIGS. 6 to 8, nor does it include an end part similar to the part 47 of FIGS. 6 to 8. Consequently, all of the liquid flows out of the half 71 through the central opening 74.

Figures 9, 10, 11, 12:
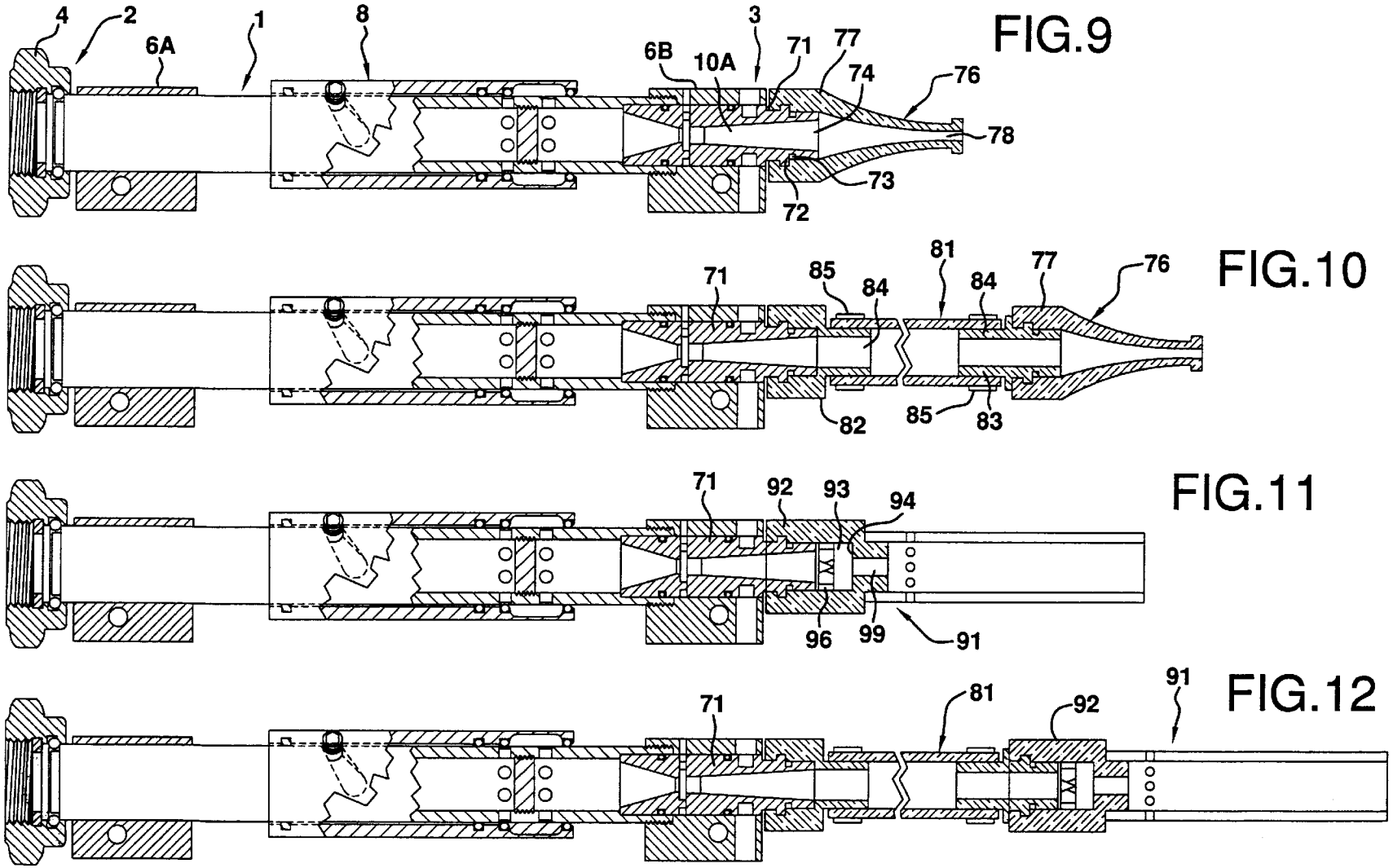
FIG. 9 is a sectional view showing an alternative construction of a handle and coupling connected to a straight jet nozzle.
FIG. 10 is a view similar to FIG. 9 but showing a hose between the coupling and the straight jet nozzle.
FIGS. 11 and 12 are views similar to FIGS. 9 and 10, respectively, but with a foam nozzle.
Figure 15:
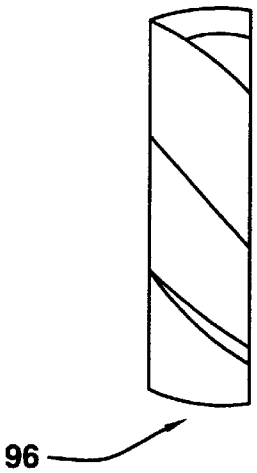
FIGS. 14 and 15 are front and side views of the swirler shown in FIG. 13.
Figure 14:
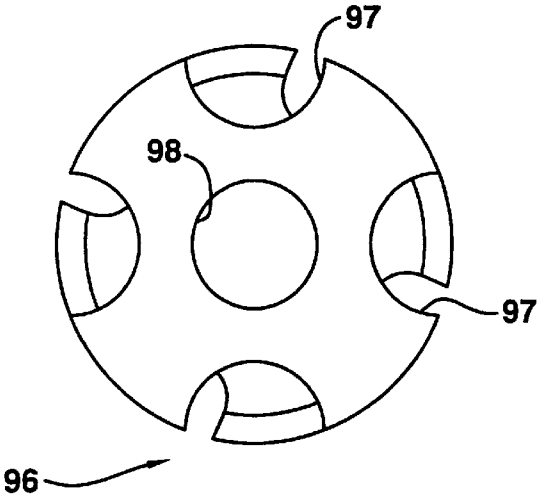
Figure 13:
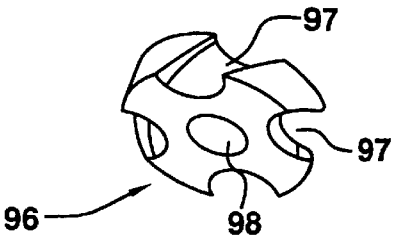
FIG. 13 is a perspective view of a swirler for use with a foam nozzle.

FIG. 9 shows a straight jet nozzle 76 coupled to the half 71. The nozzle 76 includes a coupling half 77 which mates with the half 71 as previously described. A tapered flow passage 78 through the nozzle 76 forms a straight jet stream.

FIG. 10 shows a length of hose 81 interposed between the nozzle 76 and the coupling half 71. The hose 81 includes coupling halves 82 and 83 which are similar in construction to the coupling halves 77 and 71, respectively. The coupling halves 82 and 83 also include tubular sections 84 which extend into and are secured to the ends of the hose 81 by clamps 85.

FIGS. 11 and 12 show the use and construction of a foam nozzle 91 which is similar to the low expansion foam nozzle 26. The nozzle 91 includes a coupling half 92 which mates with the coupling half 71. Internally of the half 92 is a cylindrical cavity 93 which receives the end portion of the coupling half 71. The bottom 94 of the cavity 93 is spaced from the end of the half 71, and a part 96 is fastened in the cavity 93 between the coupling half 71 and the bottom 94. The part 96 is better shown in FIGS. 13 to 15, and it is referred to herein as a swirler. The swirler 96 is in the shape of a disc which is pressed into tight engagement with the outer wall of the cavity 93 and the swirler is spaced from both ends of the coupling half 71 and the bottom 94 of the cavity. A plurality of angled slots or grooves 97 are formed adjacent the outer periphery of the swirler, and a central hole 98 is also formed in it. Consequently, liquid leaving the coupling half 71 flows through the angled slots 97 and the hole, and a turbulent flow is produced downstream of the swirler 96 and through the hole 99 of the nozzle 91.

FIG. 11 shows the nozzle 91 attached directly to the coupling half 71, and FIG. 12 shows the hose 81 interposed between the coupling half 71 and the nozzle 91.

Figure 17:
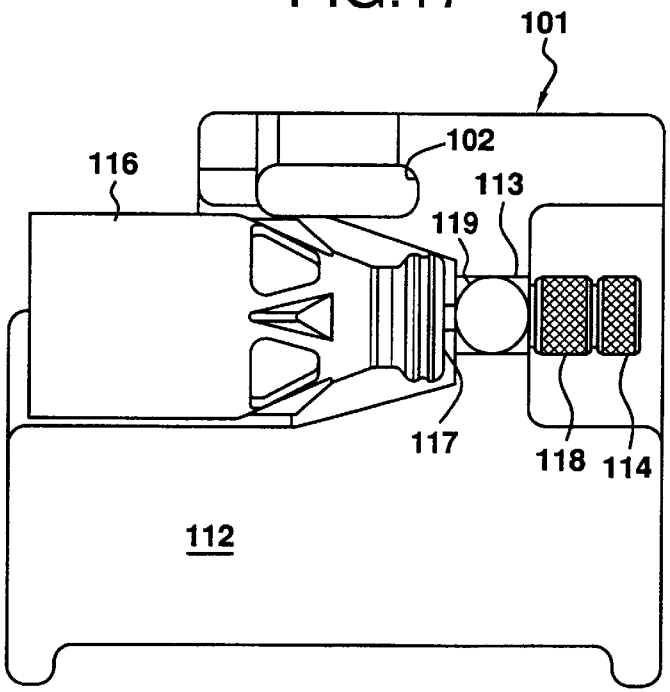
FIG. 17 is a view of the other side of the kit shown in FIG. 16.
Figure 18:
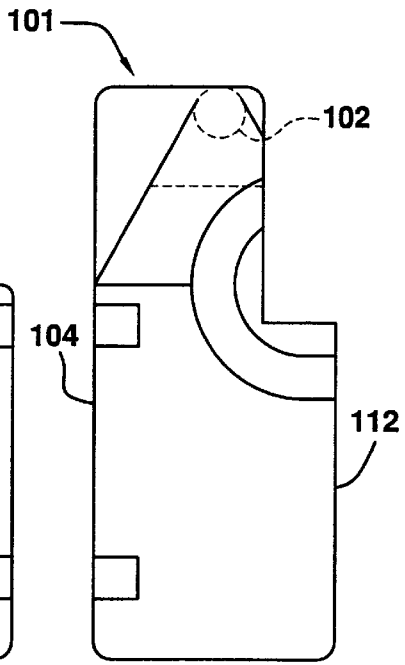
FIG. 18 is an end view of the kit shown in FIGS. 16 and 17.
Figure 16:
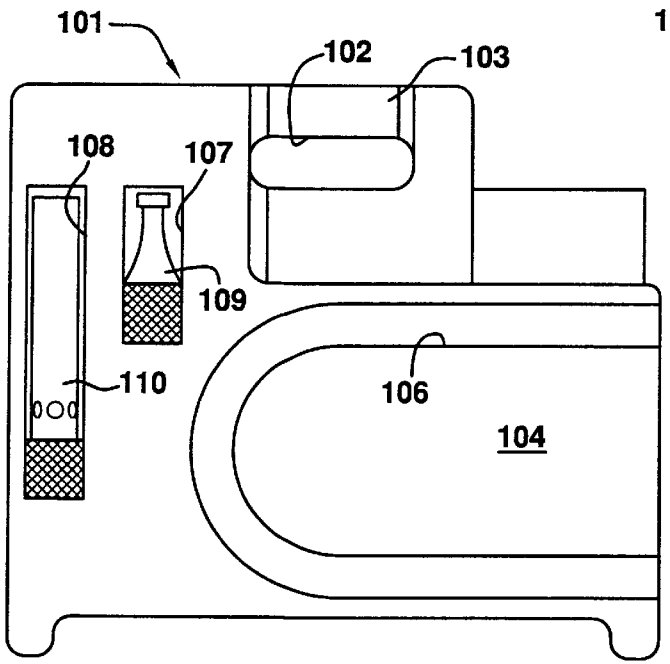
FIG. 16 is a view of one side of an alternative embodiment of the kit.

FIGS. 16 to 18 illustrate an alternative construction of the tank which stores the liquid additive. The tank 101 may be formed, for example, of a sturdy molded plastic and forms an internal reservoir for a liquid additive. The tank 101 has the general shape of, for example, a suitcase, and an opening 102 forms a finger space of a handle 103. One outer side 104 of the tank is flat and has a U-shaped slot 106 in it, which receives a length of hose (not shown) similar to the hose 21. Two additional slots 107 and 108 receive nozzles 109 and 110 which may be similar to the nozzles 25 and 26. On the other side 112 of the tank 101 is secured a tube 113 which forms a liquid flow path for, for example, water. A coupling half 114 is fastened to the intake end of the tube 113, and a nozzle 116 (such as a medium expansion foam nozzle) is removably fastened to the outlet end 117 of the tube 113. A manual flow control valve 118 is mounted in the tube 113, and an eductor 119 is connected between the tube flow path and the reservoir. The nozzle 116 may be used in the position shown or replaced by one of the other accessories as described in connection with FIGS. 5A to 5F.

Figure 20:
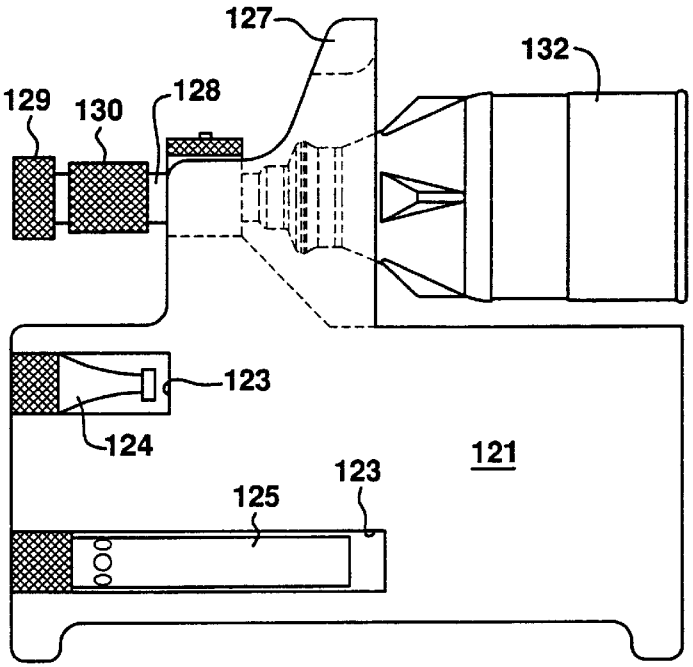
FIGS. 19, 20 and 21 are views similar to FIGS. 16, 17 and 18, respectively, but shown another alternative embodiment of the kit.
Figure 21:
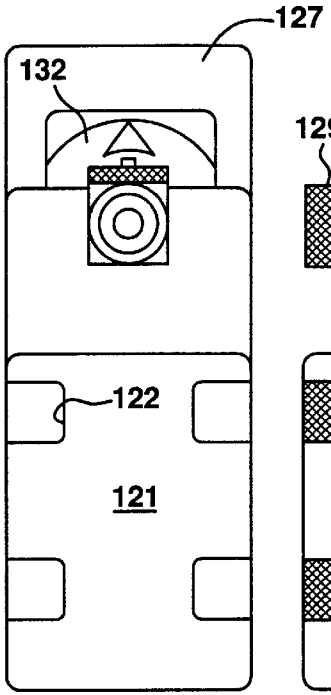
Figure 19:
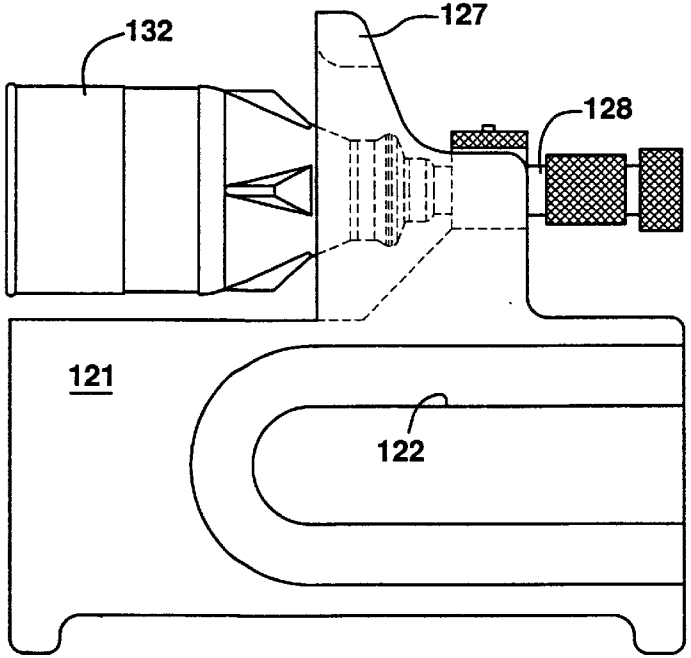

FIGS. 19 to 21 show another kit construction including a tank 121. A U-shaped slot 122 for a hose is formed on one side of the tank, and two slots 123 for nozzles 124 and 125 are formed on the other side of the tank. A handle 127 is formed on the upper side of the tank 121. A tube 128 forming a flow path, a coupling part 129 and a valve 130 are provided on the upper side of the tank. Again, a foam nozzle 132 is coupled to the outlet end of the tube 128.

It will be understood that the kit, or system, can be stored with all the discharge components in their respective places which gives the smallest storage volume in a compartment, or with the commonly used combination of discharge devices and/or hose in place ready for use. The tank is sized to enable it and the accessories and an additive in the tank to be readily carried to the scene of a fire by a typical firefighter. The accessories enable the firefighter to select or change to the most appropriate accessory at the scene of a fire. The control valve which may be in the carrying handle or between the handle and the supply hose, may be turned off to enable a change in accessory. The intake coupling half of the accessory hose 21 preferably has the same construction as the coupling half of the straight jet nozzle 25.

What is claimed is:

1. A kit for firefighters comprising:

a shell with a handle;

a tank for storing additive within the shell;

an outlet end coupling comprising a central hole and a plurality of flow slots that extend axially and circumferentially from the central hole;

an inlet end coupling on the shell that it connectable to a supply of liquid under pressure to provide a flow of liquid through the handle to the outlet end coupling;

two nozzles, each with an end shaped fit on the outlet end coupling;

storage recesses formed in the shell and shaped to receive the nozzles for storage in a vertical position by sliding the nozzle axially downwardly into the recess; and an eductor enabling additive from the tank to be selectively added to the flow of liquid without the liquid entering the tank.

2. A kit for firefighters comprising:

a shell with a handle;

a tank for storing additive within the shell;

an inlet end coupling on the shell that it connectable to a supply of liquid under pressure to provide a flow of liquid through the handle to an outlet end coupling;

two nozzles, each with an end shaped to fit on the outlet end coupling;

storage recesses formed in the shell and shaped to receive the nozzles for storage in a vertical position by sliding the nozzle axially downwardly into the recess; and an eductor enabling additive from the tank to be selectively added to the flow of liquid without the liquid entering the tank.

3. A liquid-additive kit to be carried by a firefighter, the kit comprising:

a shell with a handle;

a tank for storing additive within the shell;

an inlet end coupling on the shell that is connectable to a supply of liquid under pressure to provide a flow of liquid through the handle to an outlet end coupling having a plurality of outer slots spaced radially outwardly from a central hole;

a jet nozzle with a jet intake coupling shaped to fit on the outlet end coupling while blocking the outer flow slots;

a foam nozzle with a foam intake coupling shaped to fit on the outlet end coupling without blocking the outer flow slots;

storage recesses formed in the shell and shaped to receive the nozzles for storage; and an eductor enabling additive from the tank to be selectively added to the flow of liquid without the liquid entering the tank.

4. A liquid-additive kit to be carried by a firefighter, the kit comprising:

a shell with a detachable handle;

a tank for storing additive within the shell;

an inlet end coupling on the shell that is connectable to a supply of liquid under pressure to provide a flow of liquid through the handle to an outlet end coupling;

two nozzles, each with an end shaped to fit on the outlet end coupling;

storage recesses formed in the shell and shaped to receive the nozzles for storage; and an eductor enabling additive from the tank to be selectively added to the flow of liquid without the liquid entering the tank.

5. The kit as set forth in claim 4, in which the handle is secured to the shell by one or more pins.

6. A liquid-additive kit to be carried by a firefighter, the kit comprising:

a shell with a handle;

a tank for storing additive within the shell;

an inlet end coupling on the shell that is connectable to a supply of liquid under pressure to provide a flow of liquid through the handle to an outlet end coupling;

a foam nozzle and a second nozzle, each with an end shaped to fit on the outlet end coupling;

storage recesses formed in the shell and shaped to receive the nozzles for storage;

a swirler that can be mounted between the outlet end coupling and the foam nozzle to create turbulence in the flow of liquid entering the foam nozzle; and an eductor enabling additive from the tank to be selectively added to the flow of liquid without the liquid entering the tank.

* * * * *

UNITED STATES PATENT AND TRADEMARK OFFICE

CERTIFICATE OF CORRECTION

PATENT NO. : 6,113,004

DATED : September 5, 2000

INVENTOR(S) : Robert W. Steingass et al.

It is certified that error appears in the above-identified patent and that said Letters Patent is hereby corrected as shown below:

Claim 1, Column 9, Line 15, missing "to" between - end shaped <u>to</u> fit on the -

Signed and Sealed this

First Day of May, 2001

*Attest:*

Nicholas P. Godici

NICHOLAS P. GODICI

*Attesting Officer*

*Acting Director of the United States Patent and Trademark Office*